United States Patent [19]

Beckerer

[11] 4,363,350

[45] Dec. 14, 1982

[54] SELF-DRAINING BOAT WINDOW

[76] Inventor: Frank S. Beckerer, 134 Far Horizons Dr., Easton, Conn. 06612

[21] Appl. No.: 203,046

[22] Filed: Nov. 3, 1980

[51] Int. Cl.[3] ..... E06B 7/14

[52] U.S. Cl. ..... 160/92; 52/209; 49/408; 49/476

[58] Field of Search ..... 52/209; 160/92; 49/408, 49/476

[56] References Cited

U.S. PATENT DOCUMENTS

| | | | |
|---|---|---|---|
| 187,419 | 2/1877 | Saur | 49/476 |
| 1,919,367 | 7/1933 | Hamm et al. | 49/408 |
| 2,187,476 | 1/1940 | Moundson | 49/476 |
| 4,095,640 | 6/1978 | Beckerer | 160/92 |
| 4,112,645 | 9/1978 | Greenfield | 52/209 |

FOREIGN PATENT DOCUMENTS 468413 7/1937 United Kingdom .

*Primary Examiner*—Price C. Faw, Jr.

*Assistant Examiner*—Cherney S. Lieberman

*Attorney, Agent, or Firm*—H. Gibner Lehmann; K. Gibner Lehmann

[57] ABSTRACT

A self-draining, leak-resistant boat window comprising a frame body having a continuous mounting flange for engagement with an inner surface surrounding an opening in the boat hull. The body has a spigot which is connected with the mounting flange. A low portion of the spigot has an upwardly facing drain surface constituting a sill. The sill has a downwardly offset portion provided with a sloping, upwardly-open drain groove which extends from a high location adjacent the mounting flange to a low location, remote from the mounting flange. The arrangement is such that water which is splashed onto the sill is channeled toward the offset portion, and thereby drained away. There is thus minimized the tendency for water to collect on the sill and leak into the boat interior when the window pane is opened.

13 Claims, 7 Drawing Figures

SELF-DRAINING BOAT WINDOW

BACKGROUND

This invention relates generally to window constructions for boats, and more particularly to leak-resistant arrangements which minimize the likelihood of water that has inadvertently collected on the window sill from entering the interior of the boat.

In particular, the present invention involves an improvement in the construction disclosed and claimed in applicant's U.S. Pat. No. 4,095,640 dated June 20, 1978. The patent describes a leak-resistant window having a mounting frame or flange which engages an inner surface surrounding an opening in the boat hull, and a spigot which is integral with the flange and which extends through the opening. The lower portion of the spigot forms an upwardly-facing sill which, in one embodiment, is sloped with respect to the plane of the window so as to constitute a drain surface. This surface is indicated by the numerals 90 in FIG. 3, 90*a* in FIG. 4, and 19*b* in FIG. 10 of this patent.

While the patented construction has been found to operate quite well, there still existed a pronounced tendency for splashed water to collect on the drain surface 90 or 90*a* at such time that the boat keeled. The angle which the surface 90 makes with a horizontal plane is shown as being on the order of 20 degrees or so. In cases where the boat keeled by an extent greater than this figure, any water which occupied the area in the vicinity of the sill would tend to collect at the location adjacent to the screen frame 78 and gasket 160. If the window pane 20 were then opened, the collected water could run into the boat interior.

In the patented construction it was not considered practical to increase the slope of the drain surface 90 to any appreciably greater extent, since such a construction could result in a significantly thickened piece of plastic material at the location of the sill. With parts having thicknesses greater than that shown, problems occurred in attaining proper curing of the plastic. That is, the curing time was increased unnecessarily, and in addition there resulted a tendency for the plastic material to warp and deform, causing cracks or other undesirable characteristics to be imparted to the surface 90.

One approach to circumvent the problems with curing, as noted above, was to modify the configuration of the spigot in a manner similar to that shown in FIG. 10 of the patent. This construction resulted in thinner plastic parts which were better adapted to molding. However, the disadvantage in this arrangement was that the opening in the boat hull was best made skewed, in order to accommodate the similarily shaped spigot. In addition, the opening in the securement plate 96 usually has to be specially shaped.

It has been proposed to provide a series of drain holes through the sill, extending from the area adjacent to the window screen downwardly at a sharp angle, to the undersurface of the spigot. Such arrangements did not meet with much success, however, due to the likelihood of such confined drain passages becoming easily clogged with salt residue, sand, or other foreign material. Accordingly these constructions did not enjoy wide acceptance in the boating field.

SUMMARY

The above disadvantages and drawbacks of prior window constructions for boats are obviated by the present invention which has for an object the provision of an improved self-draining, leak-resistant boat window which is especially simple in construction and reliable in its intended operation.

A related object is the provision of a boat window as above characterized, which can be readily molded in relatively simple mold cavities.

Still another object is the provision of a window incorporating molded parts wherein the parts are of relatively thin cross section, so as to facilitate proper curing of the plastic, and minimize the tendency for warping or deformation of the parts to occur.

A still further object is to provide a window construction which incorporates a special drainage arrangement that can channel splashed water that has collected on the window sill, even under conditions where the boat has keeled by an extent greater than 20 degrees or so. The arrangement is such that regardless of the keel of the boat, water which would normally collect on the sill is effectively drained therefrom, minimizing the probability of such water running into the interior of the boat when the window is opened.

A still further object is to provide a boat window of the type having a sloping sill wherein auxiliary draining structures are provided to effectively drain off water under virtually all conditions, and with minimum possibility of clogging of the drain passages after prolonged periods of use. The arrangement is such that most or all of the drain surfaces are completely exposed and accessible, such that they inherently resist clogging, and can be readily wiped clean with a cloth or towel, should the need ever arise.

The above objects are accomplished by the provision of a self-draining, leak-resistant boat window comprising a frame body having a continuous mounting flange for engagement with an inner surface surrounding an opening in the boat hull, and having a spigot connected with the mounting flange. A window pane is hingedly connected to the mounting flange, and closes off the opening formed by the spigot. A low portion of the spigot has an upwardly facing drain surface, constituting a sill. The sill has a downwardly offset portion provided with an upwardly-open, sloping drain groove which extends from a high location adjacent to the mounting flange to a low location, remote from the mounting flange. The arrangement is such that water which is splashed onto the sill is channeled toward the offset portion, and thereafter drained away. There is thus minimized the tendency for water to collect on the sill and enter the interior of the boat when the window pane is opened.

Other features and advantages will hereinafter appear.

In the drawings, illustrating several embodiments of the invention:

Figure 1:
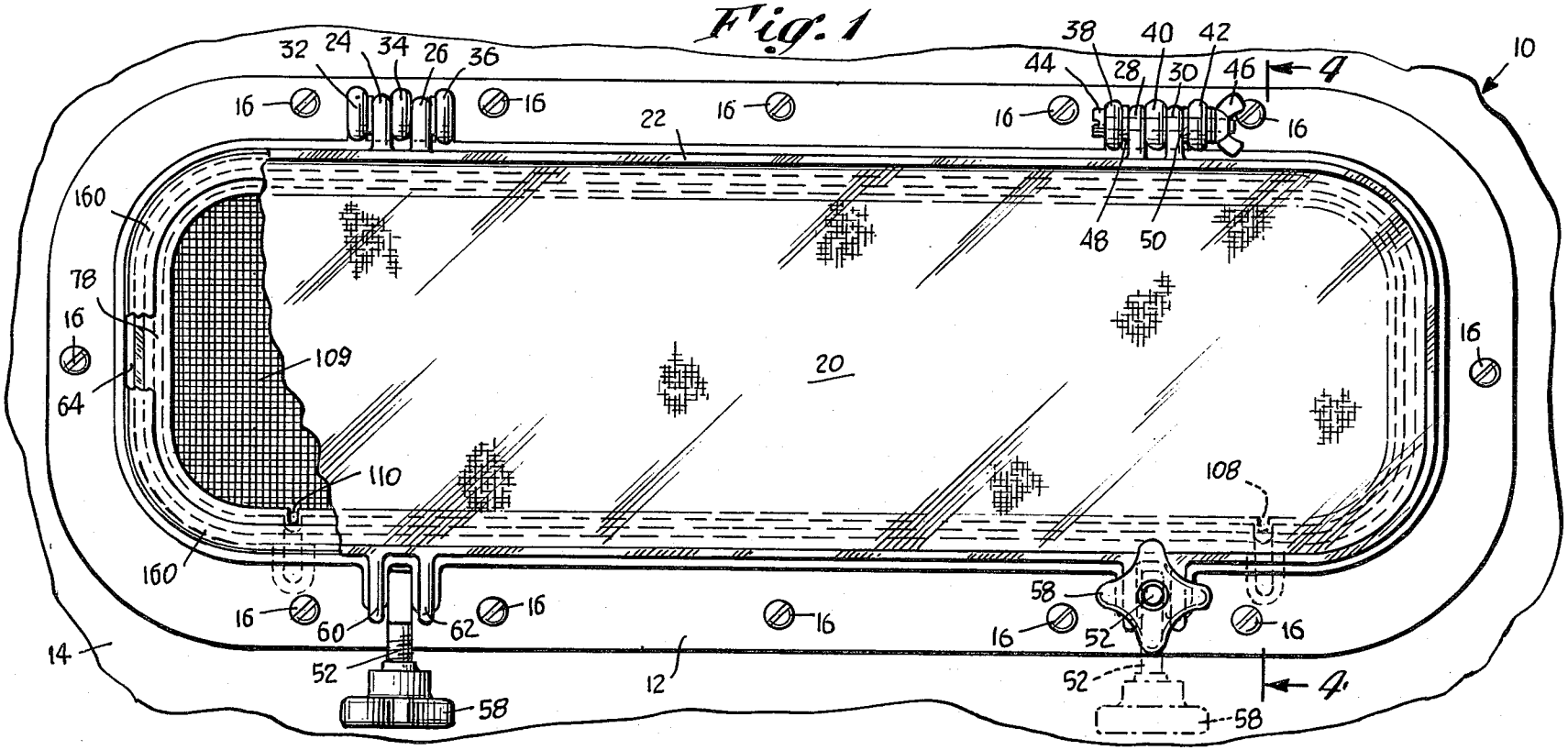
FIG. 1 is a top plan view of the improved leak-resistant boat window of the present invention.
Figure 4:
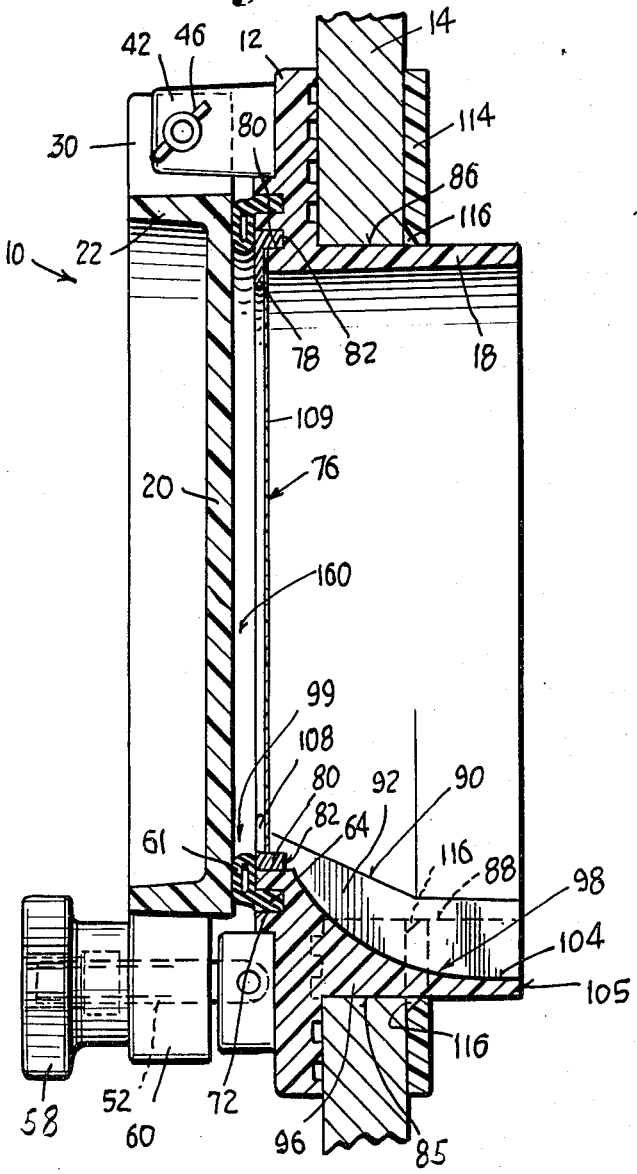
FIG. 4 is a section taken on the line 4—4 of FIG. 1.
Figure 3:
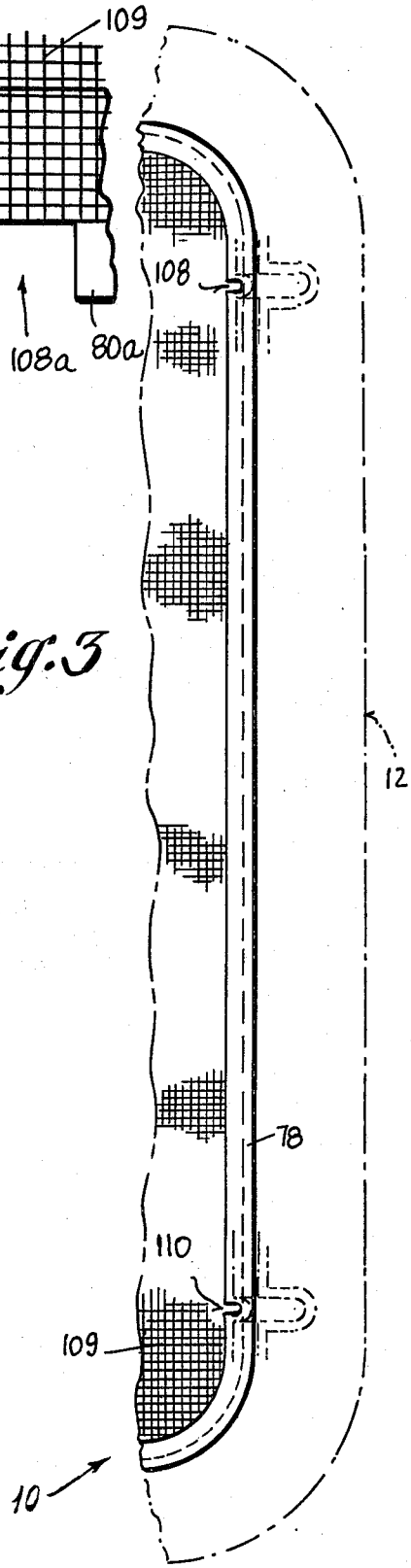
FIG. 3 is a fragmentary top plan view of the window with the pane opened, showing the location of two drain notches in the frame of a window screen used with window.

FIGS. 1–4 show a boat window generally designated by the numeral 10, for installation in a suitable porthole or opening of a boat hull. The window construction includes a continuous frame body having a mounting flange 12 which seats against the inner surface of the boat hull 14 as shown in FIG. 4, being secured in place by means of multiple screws 16. The body further includes a spigot or spigot wall 18 connecting with the mounting flange and adapted to extend through the opening formed in the hull 14. The flange 12 and spigot 18 are constituted of molded plastic and are formed integral with one another. There is also provided a molded plastic window pane 20, preferably transparent, which is hingedly connected to the mounting flange 12 as shown in FIG. 1. The pane 20 includes a peripheral flange portion 22 having a pair of hinge lugs 24, 26 pivotally secured to cooperable hinge lugs 32, 34, 36 by means of a spring-type hinge pin. A second pair of hinge lugs 28, 30 is pivotally secured to cooperable hinge lugs 38, 40, 42 of the flange 12 by a hinge pin in the form of a screw 44 including a wing nut 46. In addition, two resilient washers 48, 50 are provided, against which adjacent portions of the lugs bear when the wing nut 46 is tightened. Such a construction enables the window to be opened and held in such open position against the action of gravity.

Means are provided on the flange 12 and pane 20 for latching the latter in a closed position wherein the opening formed by the spigot 18 is closed off. As illustrated in FIG. 1, two latches are provided, each comprising a swivel arm 52 carried on the mounting flange 12, the end of the arm 52 being threaded and carrying a knob 58 of molded plastic construction. During the manufacture of this knob 58, a nut is incorporated and held captive, for engagement with the threads of the swivel arm 52. The flange 22 of the pane 20 includes pairs of lugs 60, 62 such that the arm 52 can be swung to a position wherein the knob 58 overlies the lugs 60, 62, after which the knob can be tightened on the arm 52 so as to secure the window in a closed position, as in FIG. 4. It will be understood that the left-hand latch mechanism in FIG. 1 is shown in the un-latched position, whereas the right-hand latch mechanism is shown in the latched position, the knob 58 having been tightened.

A leak-resistant seal is provided between peripheral portions of the window pane 20 and the adjacent portions of the mounting flange 12, in the form of a resilient gasket 160 having a portion 61 of generally oval cross-sectional configuration. Secured at one edge of the gasket 160 is a protruding rib 64 connected to the oval portion 61 by means of a thin web. The gasket 160 can be constituted of resilient material similar to that manufactured under the trademark "Nordel", by DuPont.

As shown in FIG. 4, the mounting flange 12 includes a peripheral groove 72 which is adapted to receive the protruding rib 64 of the gasket 160. During such assembly the rib 64 is merely pressed into the groove 72 and frictionally grips the opposite walls thereof to prevent inadvertent removal. During manufacture, the gasket is formed by extrusion and cut into predetermined lengths of the proper size, and the ends joined together by suitable cement. The gasket is then installed on the mounting flange 12 as shown in FIG. 4. I have found that by reducing the length of the gasket, and thereafter requiring it to be stretched an extent when installed on the window, the tendency of the gasket to buckle at the corners of the mounting flange 12 is virtually eliminated. As an example, I have found that in a window having a groove 72 with a 36½ inch periphery, a satisfactory unstretched circumference for a gasket loop has been found to be 34¼ inches.

As can be readily understood, the amount of stretching which occurs at the inner radius of the gasket in the vicinity of the corner is relatively small, with the stretching which occurs at the outer radius being substantially greater. Such pre-stressing of the gasket has been found to be very effective in maintaining the gasket in a flat or uniform condition.

Due to the resilience of the oval portion 61, the gasket maintains an expanded shape when the window is open, with no signs of curling or buckling. When the pane 20 is closed and latched in place, the oval portion 61 flattens, as shown in FIG. 4. Due to the resilience of the gasket and the distortion which occurs, the above construction has been found to be very effective in providing a seal between the pane 20 and the mounting flange 12. Assembly of the gasket is greatly facilitated by the provision of the protruding rib 64 and groove 72, such assembly requiring neither skilled personnel nor special equipment. Should replacement of the gasket ever be required, it can be readily removed by exerting additional force in an outward direction. The force required to remove the gasket, however, is considerably greater than that normally exerted on it under conditions of normal use. Accordingly, it tends to stay in its proper position, all without requiring special adhesives, cement, or the like.

As shown in FIG. 4, the body of the window optionally includes a screen 76 having a wire or cloth mesh of usual construction, and a peripheral screen frame 78. The latter can be molded around the mesh, in order to provide a one-piece unit. The screen 76 includes a flange 80 which can be either continuous or partly discontinuous, and which is received in a corresponding peripheral continuous or discontinuous groove 82 of the flange 12, the flange 80 and groove 82 constituting a tongue and groove formation for securing the screen 76 to the remainder of the body.

Assembly of the screen 76 can be readily effected prior to the installation of the gasket 160, by merely dropping the screen in place. Thereafter, the gasket 160 can be installed in the manner indicated above. Following such installation, it can be seen that the screen will be held in position by the gasket 160, even when the pane 20 is swung to its open position.

The spigot flange 18 has oppositely disposed external or outer wall surfaces 86, 88 substantially parallel to one another, for engagement with the hull 14, with one inner wall of the flange having a sloping surface or sill 90 defining a tapered cross-sectional area 92. Such a construction provides drainage of water from the spigot, by gravity, even when the hull 14 is tilted somewhat from the vertical, as during moderate keeling of the boat. The tapered area 92 is preferably integral with the remainder of the spigot, being formed during the molding thereof.

Figure 2:
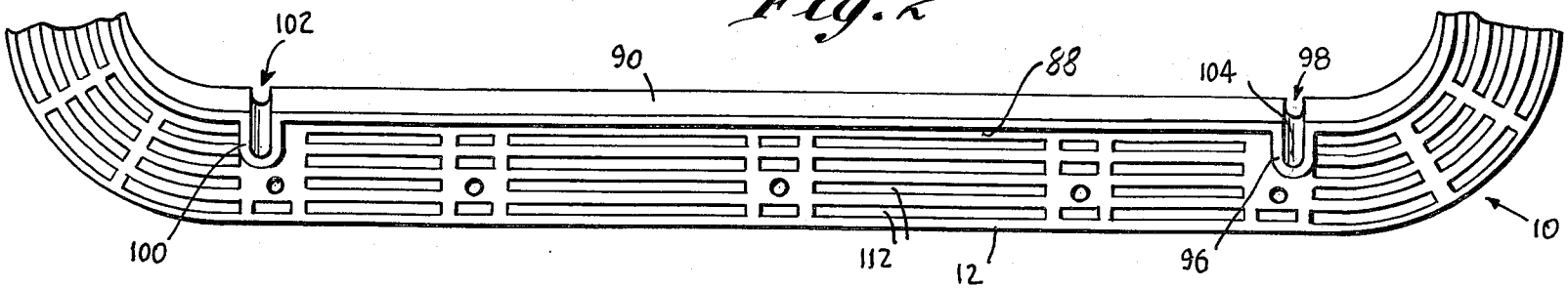
FIG. 2 is a fragmentary view of the underside of the window of FIG. 1, particularly showing the sill, and a pair of upwardly-open drain grooves associated therewith.

In accordance with the present invention, the sill 90 has a downwardly offset portion 96 with an upwardly-open drain groove 98 which extends from a high location closely adjacent to the mounting flange 12 to a low location remote from the flange 12. As illustrated in FIG. 2, there is provided a second downwardly offset portion 100 having an upwardly-open drain groove 102, this portion 100 being disposed toward the opposite end of the sill 90. As illustrated in FIG. 4 the bottom wall 104 of the drain groove 98 is curvilinear lengthwise, and has a concave configuration. In FIG. 2, the downwardly offset portion 96 of the spigot is of generally U-shaped cross section, taken vertically.

Referring to FIG. 4, it can be seen that the lower portion of the groove 82 that receives the tongue or flange 80 of the screen frame communicates directly with the upper portion of the wall 104 of the groove 98 to provide for drainage of water from the groove 82, and from the area designated by the arrow 99 in FIG. 4, such area lying between the pane 20 and the screen 76. In further providing for virtual complete drainage of water from this area, by the present invention the inner periphery of the screen 76 is provided with cut-outs or notches 108, 110, to enable water lying between the pane 20 and frame 76 to flow along the lower quadrant of the gasket 160 and directly into the groove 98 (or 102). Without such notches 108, 110 there would be a possibility of water being trapped between the pane 20 and screen 76, with the window closed. Upon opening the window, this water would enter the interior of the boat.

Figure 5:
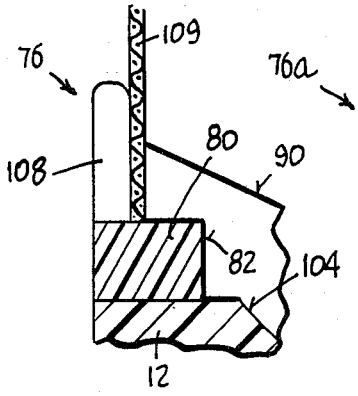
FIG. 5 is a fragmentary vertical section of the mounting flange, sill, and window screen, showing details of the drain notch in the screen frame.

In FIGS. 4 and 5 the screen frame is shown as being generally of L-shaped cross section, with the body (upper part) of the L, or the inner periphery of the screen frame, containing the notch 108. The screen mesh is labelled 109 and is preferably molded in place in the screen frame.

Figure 6:
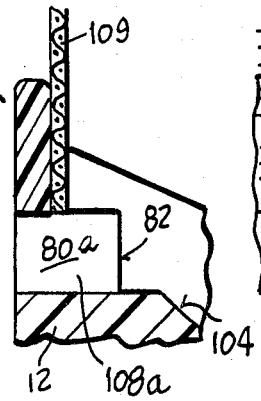
FIG. 6 is a view like FIG. 5, except showing a modified screen having a frame which is notched at its outer periphery, constituting another embodiment.
Figure 7:
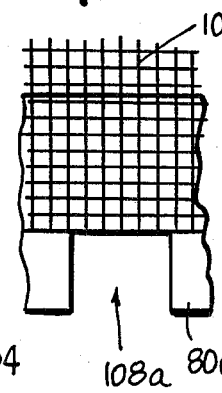
FIG. 7 is a fragmentary view of the screen of FIG. 6.

Another embodiment of the invention is illustrated in FIGS. 6 and 7, showing a modified screen **76*a* of L-shaped cross section, wherein the outer periphery or base of the screen frame contains the drainage notches 108*a*. Preferably two notches similar to that designated 108*a* are provided, such notches being in alignment with the grooves 98, 102 respectively. The notches 108*a* would operate to provide drainage passages from the area indicated by the arrow 99 in FIG. 4 to the respective drainage groove 98 or 102**.

As particularly illustrated in FIG. 5, the upper portion of the wall 104 of the groove 98 is closely adjacent to the continuous groove 82 into which the flange 80 fits, such that there is little or no resistance to gravity flow of water, from the area indicated by the arrow 99 in FIG. 4.

The above construction is seen to have the following advantages. The downwardly offset portions 96, 100 can be molded integral with the spigot 18, at substantially no increased manufacturing cost. The portions 96, 100 are downwardly offset with respect to remaining areas of the sill 90. In the event that there is a tendency for splashes to collect in the area indicated by the arrow 99 in FIG. 4, the collected water is effectively drained away by both the sill 90 and grooves 98, 102 at such time as the boat is substantially level or only moderately keeled, and exclusively by the drain grooves 98, 102 in the event of keeling of the boat by an extent greater than the slope of the sill 90 from a horizontal plane. Thus, under virtually all conditions, excess water is effectively channeled off.

Due to the fact that the drainage paths provided by the grooves 98, 102 are open upwardly there is minimized the possibility of their becoming clogged with sand, salt or other debris after a period of use. This was not true in some prior constructions, wherein closed drain passages (holes) were employed. Drainage holes tend to become clogged easily, and in addition free flow is sometimes impeded by capillarity. With the present construction, should the grooves 98, 102 ever become clogged, it is a fairly simple matter to clean them by merely wiping out the residue with a cloth, perhaps with the aid of a pointed instrument or tool.

Also, the present arrangement effectively channels the drained water to a location which is remote from the hull 14, that is, over the lip of the groove and downward. The lip of the groove 98 is indicated by the numeral 105 in FIG. 4. Accordingly there is virtually no possibility of water running back toward the cut-out 85 in the hull, and settling there or seeping inside.

FIG. 2 illustrates the sloping surface or sill 90 of the spigot as well as a series of recesses 112 in the flange 12. The recesses 112 constitute clearance surfaces into which any excess sealing compound can flow. Such compound is employed around the joint between the flange 12 and the hull 14. In addition, the recesses provide an improved bonding surface, as can be understood.

Referring again to FIG. 4, a mounting plate 114 is provided, engageable with the opposite surface of the hull 14 and adapted to seal thereagainst. The inner peripheral edge 116 of the plate 114 is beveled as shown, providing a reservoir space. During installation, when sealing compound is applied to the underside of the plate 114 and to the outer surface 86, 88 of the spigot flange, the compound tends to be forced against the flanges as the plate is installed, rather than being scraped from the surface as would be the case where the inner peripheral edge perfectly square. An improved seal between the surfaces 86, 88 and plate 114 thereby results.

The knob 58 is seen to include a central raised portion which constitutes a centering means for the knob 58 between the lugs 60, 62 of the pane 20. Such a construction has been found to improve the operation of the latches, by reducing the tendency of the swivel pin 52 to become seated in a position which is eccentric with respect to the U-shaped opening formed by the lugs 60, 62.

From the above, it can be seen that I have provided a novel and improved leak-resistant boat window which is exceedingly simple in construction, yet reliable in use. The plastic components can be readily molded, and the gasket manufactured in the form of an extrusion. A suitable substance for the pane 20 has been found to be polycarbonate; suitable material for the frame and spigot portions has been found to be that known as plexiglass DR.

Problems of leakage and deterioration of the seals as associated with prior window constructions are largely eliminated by the above organizations. The device is thus seen to represent a distinct advance and improvement in the technology of boating accessories.

Each and every one of the appended claims defines a distinct aspect of the invention separate from the others, and each claim is accordingly to be treated in this manner when the prior art devices are examined in any determination of novelty or validity.

Variations and modifications are possible without departing from the spirit of the invention.

I claim:

1. In a self-draining, leak-resistant boat window, in combination:

(a) a frame body comprising a continuous mounting flange for engagement with an inner surface surrounding an opening in the wall of a boat, (b) said body including a spigot connected with said flange and defining the window opening and having a lower portion characterized by an upwardly-facing drain surface constituting a sill, said spigot being adapted to extend through said wall opening of the boat, (c) a window pane for closing off the window opening formed by the spigot, and (d) means hingedly connecting said window pane to said mounting flange, (e) said sill of the spigot having a portion which is downwardly offset with respect to remaining areas of the sill, said downwardly offset portion being provided with a sloping drain groove extending from a high location closely adjacent said mounting flange to a low location disposed remote from the mounting flange (f) said drain groove being open at the top for a substantial portion of its length, thereby defining an open channel which resists the tendency for residue to form therein and cause possible clogging.

2. The invention as defined in claim 1, wherein:

(a) said sill has a portion which is sloped with respect to the plane of the window, in order to provide for drainage of water in a direction away from the window pane.

3. The invention as defined in claim 2, wherein:

(a) said drain groove has a portion whose slope exceeds the slope of the sill, thereby to collect drainage from the latter and channel it away from the window pane.

4. The invention as defined in claim 1, wherein:

(a) the mounting flange has opposite, upstanding portions at the ends of the sill, (b) said sill having an additional downwardly-offset portion and a sloping, upwardly-open drain groove similar to said first-mentioned offset portion and groove, (c) said offset portions and grooves being disposed at the end portions of the sill adjacent the upstanding flange portions.

5. The invention as defined in claim 1, wherein:

(a) the bottom wall of the drain groove is curvilinear lengthwise, and is concave.

6. The invention as defined in claim 1, wherein:

(a) the downwardly offset portion of the spigot is generally of U-shaped cross section, taken vertically.

7. The invention as defined in claim 1, wherein:

(a) the mounting flange has a continuous groove extending in its upper, side and lower portions and adapted to receive the frame of a screen, (b) said drain groove extending closely adjacent the lower portion of said continuous groove.

8. The invention as defined in claim 7, and further including:

(a) a screen comprising a screen frame, (b) the inner periphery of said screen frame having a drainage notch adjacent the location of said upwardly-open drain groove such that water occupying the area between the screen and window pane can drain through the notch and into the drain groove of the sill.

9. The invention as defined in claim 7, and further including:

(a) a screen comprising a screen frame, (b) the outer periphery of said screen frame having a drainage notch adjacent the location of said upwardly-open drain groove such that water occupying the area between the screen and window pane can drain through the notch and into the drain groove of the sill.

10. The invention as defined in claim 1, wherein:

(a) the mounting flange has a continuous groove extending in its upper, side and lower portions, and adapted to receive the frame of a screen, (b) said drain groove intersecting and communicating with the lower portion of said continuous groove such that water occupying the latter can run directly into the drain groove.

11. The invention as defined in claim 1, and further including:

(a) a screen comprising a screen frame of generally L-shaped cross section, (b) the base of said L having a drainage notch adjacent the location of said upwardly-open drain groove such that water occupying the area between the screen and window pane can drain through the notch and into the drain groove of the sill.

12. The invention as defined in claim 1, and further including:

(a) a screen comprising a screen frame of generally L-shaped cross section, (b) the body of said L having a drainage notch adjacent the location of said upwardly-open drain groove such that water occupying the area between the screen and window pane can drain through the notch and into the drain groove of the sill.

13. The invention as defined in claim 1, and further including:

(a) a sealing gasket carried by the mounting flange, adapted to be engaged by the window pane, and having a portion extending adjacent to the sill, (b) the said gasket portion being disposed above the level of the highest part of the upwardly-open drain groove such that water which is splashed onto the said gasket portion can drain by gravity, into the said drain groove.

* * * * *

US004363350C1

(12) EX PARTE REEXAMINATION CERTIFICATE (5686th)

United States Patent
Beckerer

(10) Number: US 4,363,350 C1
(45) Certificate Issued: Mar. 6, 2007

(54) SELF-DRAINING BOAT WINDOW

(75) Inventor: Frank S. Beckerer, Easton, CT (US)

(73) Assignees: Eliose Brady; as Custodian for the use and benefit of Matthew R. Brady and Scott M. Brady; Carole A. Beckerer; as Custodian for the use and benefit of F. Sean Beckerer, Tara J. Beckerer and W.A. Beckerer; Joan X. Jones; as Custodian for the use and benefit of Katherine Jones

Reexamination Request:
No. 90/007,672, Aug. 17, 2005

Reexamination Certificate for:

| | |
|---|---|
| Patent No.: | **4,363,350** |
| Issued: | **Dec. 14, 1982** |
| Appl. No.: | **06/203,046** |
| Filed: | **Nov. 3, 1980** |

(51) Int. Cl.
*E06B 7/14* (2006.01)

(52) U.S. Cl. ..... 160/92; 52/209; 49/408; 49/476.1; 49/479.1

(58) Field of Classification Search ..... 52/209; 160/92; 49/408, 476.1
See application file for complete search history.

(56) References Cited

U.S. PATENT DOCUMENTS

| | | | |
|---|---|---|---|
| 304,183 | A | 8/1884 | Davis |
| 4,095,640 | A | 6/1978 | Beckerer |
| 4,112,645 | A | 9/1978 | Greenfield |

*Primary Examiner*—Sara Clarke

(57) ABSTRACT

A self-draining, leak-resistant boat window comprising a frame body having a continuous mounting flange for engagement with an inner surface surrounding an opening in the boat hull. The body has a spigot which is connected with the mounting flange. A low portion of the spigot has an upwardly facing drain surface constituting a sill. The sill has a downwardly offset portion provided with a sloping, upwardly-open drain groove which extends from a high location adjacent the mounting flange to a low location, remote from the mounting flange. The arrangement is such that water which is splashed onto the sill is channeled toward the offset portion, and thereby drained away. There is thus minimized the tendency for water to collect on the sill and leak into the boat interior when the window pane is opened.

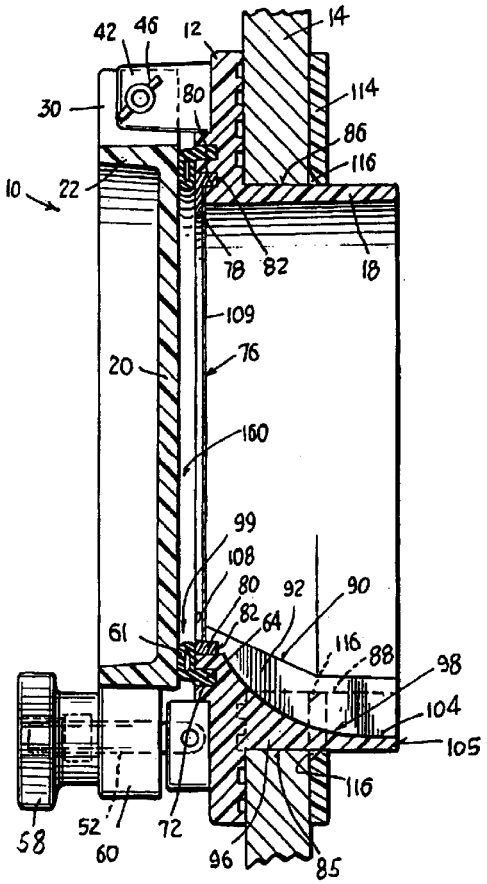

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–13 is confirmed.

* * * * *